US006834445B2

(12) United States Patent
McMullin

(10) Patent No.: US 6,834,445 B2
(45) Date of Patent: Dec. 28, 2004

(54) SHOE CLEAT WITH IMPROVED TRACTION

(75) Inventor: Faris W. McMullin, Boise, ID (US)

(73) Assignee: Softspikes, LLC, Gaithersburg, MD (US)

( * ) Notice: Subject to any disclaimer, the term of this patent is extended or adjusted under 35 U.S.C. 154(b) by 0 days.

(21) Appl. No.: 10/195,315

(22) Filed: Jul. 16, 2002

(65) Prior Publication Data

US 2004/0010944 A1 Jan. 22, 2004

(51) Int. Cl.[7] ..... A43B 5/00; A43C 15/00; A43C 13/04

(52) U.S. Cl. ..... 36/127; 36/134; 36/67 D; 36/59 B

(58) Field of Search ..... 36/127, 134, 67 D, 36/67 R, 67 A, 62, 59 C, 59 B, 67

(56) References Cited

U.S. PATENT DOCUMENTS

| | | | | |
|---|---|---|---|---|
| 39,575 | A | | 8/1863 | Hyatt et al. |
| 180,578 | A | | 8/1876 | Gansalus |
| 416,861 | A | | 12/1889 | Scafe |
| 485,459 | A | | 11/1892 | Crocker |
| 697,135 | A | | 4/1902 | Dearing |
| 962,719 | A | | 6/1910 | Pratt |
| 982,278 | A | | 1/1911 | Kline |
| 1,093,358 | A | | 4/1914 | Schroeder |
| 1,243,209 | A | | 10/1917 | Park |
| 1,304,616 | A | | 5/1919 | Smith |
| 1,355,827 | A | | 10/1920 | Finneran |
| 1,422,716 | A | | 7/1922 | Jones |
| 1,749,351 | A | | 3/1930 | McQueen |
| 1,768,426 | A | | 6/1930 | Stelzer |
| 1,827,514 | A | | 10/1931 | Golden |
| 1,876,195 | A | | 9/1932 | Youmans |
| 2,185,397 | A | | 1/1940 | Birchfield |
| 2,213,289 | A | | 9/1940 | Riddell |
| 2,223,794 | A | | 12/1940 | Pierce et al. |
| 2,258,805 | A | | 10/1941 | Phillips |
| 2,276,887 | A | | 3/1942 | Smith |
| 2,292,299 | A | | 8/1942 | Smith |
| 2,336,632 | A | | 12/1943 | Park |
| 2,423,753 | A | | 7/1947 | Brooks |
| 2,491,596 | A | | 12/1949 | Zaleski et al. |
| 2,626,454 | A | * | 1/1953 | Richardson ..... 36/127 |
| 2,740,208 | A | | 4/1956 | Dye |
| 2,745,197 | A | | 5/1956 | Holt |
| 2,758,396 | A | | 8/1956 | Edwards |

(List continued on next page.)

FOREIGN PATENT DOCUMENTS

| | | |
|---|---|---|
| AT | 109770 | 5/1928 |
| CA | 2231216 | 9/1998 |

(List continued on next page.)

OTHER PUBLICATIONS

Softspikes, Inc., Advertisement, *Golf Digest*, Dec. 1996, p. 149.

Advertisement "Introducing Gripper Golf Cleats", Feb. 1997.

Purkey, M., "The Spikeless Debate," Nov. 5, 1996.

"#10 Soft Spikes,"*Golf World*, p. 65, 1996 Annual Issue.

*Primary Examiner*—Anthony Stashick
(74) *Attorney, Agent, or Firm*—Edell, Shapiro & Finnan, LLC

(57) ABSTRACT

A shoe cleat with improved traction includes at least one resiliently flexible traction element extending from a hub and being resiliently deflectable in a direction toward the sole of a shoe when the cleat is secured to the sole. The cleat is further configured to trap and engage blades of grass during resilient deflection of the traction element when the shoe is forced against a turf surface. The grass blades are frictionally engaged and secured in a non-planar engaging area by the traction element resulting in an enhanced traction of the shoe with respect to the turf surface. A convex foot on the traction element includes a suitable curvature to facilitate sliding of the foot along the turf surface as the traction element deflects to avoid penetration into the turf.

57 Claims, 6 Drawing Sheets

U.S. PATENT DOCUMENTS 2,774,151 A 12/1956 Dahlquist et al.
2,784,503 A 3/1957 Anderson
2,803,070 A 8/1957 Passidomo et al.
2,844,833 A 7/1958 Odermatt
2,895,235 A 7/1959 Melchiona
3,328,901 A 7/1967 Strickland
3,487,563 A 1/1970 Austin
3,512,275 A 5/1970 Leavitt
3,559,310 A 2/1971 Kiela
3,561,140 A 2/1971 Ludwig
3,583,082 A 6/1971 Jordan, Jr.
3,583,083 A 6/1971 Drew
3,656,245 A 4/1972 Wilsom
3,672,077 A 6/1972 Coles
3,747,238 A 7/1973 Jankauskas
3,766,670 A 10/1973 Nakajima
3,775,874 A 12/1973 Bonneville
3,818,617 A 6/1974 Dassler et al.
3,859,739 A 1/1975 Dassler
3,890,725 A 6/1975 Lea et al.
4,014,114 A 3/1977 Jordan et al.
4,118,878 A 10/1978 Semon
4,141,158 A 2/1979 Benseler et al.
4,180,923 A 1/1980 Dassler
4,205,466 A 6/1980 Collins
4,233,759 A 11/1980 Bente et al.
4,299,038 A 11/1981 Epple
4,309,376 A 1/1982 Ueno et al.
4,330,950 A 5/1982 Reddien
4,360,490 A 11/1982 Collins
4,366,632 A 1/1983 Bente
4,375,728 A 3/1983 Dassler
4,392,312 A 7/1983 Crowley et al.
4,492,047 A 1/1985 Arff
4,521,979 A 6/1985 Blaser
4,527,345 A 7/1985 Lopez
4,571,852 A 2/1986 Lamarche et al.
4,587,748 A 5/1986 Collins
4,633,600 A 1/1987 Dassler et al.
D288,262 S 2/1987 Yokoishi
4,648,187 A 3/1987 Dassler
4,689,901 A 9/1987 Ilenburg
4,723,366 A 2/1988 Hagger
4,727,661 A 3/1988 Kuhn
4,777,738 A 10/1988 Giese et al.
4,782,604 A 11/1988 Wen-Shown
4,833,796 A 5/1989 Flemming
4,837,949 A 6/1989 Dufour
4,885,851 A 12/1989 Peterson
5,029,405 A 7/1991 DeHaitre
5,033,211 A 7/1991 Latraverse et al.
D320,882 S 10/1991 Collins
5,065,534 A 11/1991 Colins
5,070,631 A 12/1991 Fenton
5,077,916 A 1/1992 Beneteau
D327,975 S 7/1992 Saito et al.
D341,479 S 11/1993 Saito et al.
D341,480 S 11/1993 Saito et al.
D341,704 S 11/1993 Saito et al.
D341,705 S 11/1993 Saito et al.
5,259,129 A 11/1993 Deacon et al.
D341,938 S 12/1993 Saito et al.
D342,151 S 12/1993 Saito et al.
D342,152 S 12/1993 Saito et al.
D342,373 S 12/1993 Saito et al.
5,321,901 A 6/1994 Ketty
5,367,793 A 11/1994 Deacon et al.
5,410,823 A 5/1995 Iyoob
5,426,873 A 6/1995 Savoie
5,452,526 A 9/1995 Collins
5,483,760 A 1/1996 Kataoka et al.
5,524,367 A 6/1996 Ferreira et al.
5,533,282 A 7/1996 Kataoka et al.
5,572,807 A 11/1996 Kelly et al.
5,623,774 A 4/1997 Abbey
D385,988 S 11/1997 McMullin
D387,548 S 12/1997 McMullin
D389,299 S 1/1998 McMullin
5,791,071 A 8/1998 Rosdail
5,794,367 A 8/1998 Carroll
D401,046 S 11/1998 McMullin
D404,192 S 1/1999 McMullin
5,860,228 A 1/1999 Bathum
5,887,371 A 3/1999 Curley, Jr.
D407,893 S 4/1999 McMullin
D408,122 S 4/1999 McMullin
5,901,472 A 5/1999 Adam
D415,340 S 10/1999 McMullin
5,974,700 A 11/1999 Kelly
5,996,260 A 12/1999 MacNeill
6,023,860 A 2/2000 McMullin
6,041,526 A 3/2000 Collins
6,052,923 A 4/2000 McMullin
6,094,843 A 8/2000 Curley, Jr.
D432,770 S 10/2000 Breault
6,167,641 B1 1/2001 McMullin
D439,396 S 3/2001 Savoie
D439,733 S 4/2001 Savoie
6,248,278 B1 6/2001 Kelly
6,305,104 B1 * 10/2001 McMullin ..... 36/127
6,543,160 B2 * 4/2003 Price ..... 36/127

FOREIGN PATENT DOCUMENTS

CH 670 800 7/1989
DE 185659 6/1907
DE 156642 7/1939
DE 2529027 1/1977
DE 2540426 3/1977
DE 3438060 6/1985
DE 4316650 11/1993
EP 0 153 136 8/1985
EP 0 282 257 9/1988
EP 0 342 232 11/1989
EP 0363217 4/1990
EP 0 524 861 1/1993
FR 493748 8/1919
FR 807754 1/1937
FR 536202 4/1992
GB 6877 2/1896
GB 2814 2/1914
GB 401979 11/1933
GB 1139239 1/1969
GB 1 263 960 2/1972
GB 1378461 12/1974
GB 1434282 5/1976
GB 2004731 4/1979
GB 1 564 903 4/1980
GB 2 053 658 2/1981
GB 1587382 4/1981
GB 2 160 146 12/1985
GB 2 163 037 2/1986
GB 2 191 079 12/1987
GB 2223394 4/1990
GB 2248762 4/1992
GB 2266223 10/1993
GB 2 298 563 9/1996
GB 2322787 9/1998
IT 467815 12/1951
JP 57-30003 7/1980
JP 51-2928 5/1989
JP 7-209 1/1995
JP 3027022 5/1996
JP 9-168405 6/1997
WO 91/03960 4/1991
WO 94/28750 12/1994
WO 97/18724 5/1997
WO 98/35575 8/1998

* cited by examiner

SHOE CLEAT WITH IMPROVED TRACTION

BACKGROUND OF THE INVENTION

1. Technical Field

This invention pertains generally to improvements in traction shoe cleats and, more particularly, to a shoe cleat having enhanced traction while minimizing damage to a turf surface as well as wear to the cleat when applied to hard surfaces.

2. Discussion of Related Art

The need for providing improved traction elements for the soles of shoes on turf surfaces is well known in the art, particularly in the field of sports such as football, baseball, soccer and golf. In many sports, particularly golf, the need for providing improved traction elements must be considered in combination with limiting the wear and tear on the playing turf that can be caused by the traction elements.

Attempts have been made to provide an effective traction element for a shoe that also minimizes any damage to the turf during use. For example, U.S. Pat. Nos. 5,259,129 and 5,367,793 to Deacon et al., the disclosures of which are incorporated herein by reference in their entireties, describe golf cleats that are made from plastic rather than conventional metal golf spikes and provide frictional gripping forces on the turf surface without puncturing the turf. However, while the golf cleats described in these patents are effective in protecting the turf, they suffer from a disadvantage in that the cleats tend to wear away quickly when applied to hard surfaces such as concrete sidewalks and roadways.

In U.S. Pat No. 6,167,641 to McMullin (the McMullin '641 patent), a shoe cleat is described that provides traction on turf surfaces and is resistant to wear when applied to hard surfaces. The cleat of the McMullin '641 patent includes a hub with at least one cantilevered arm including a traction element extending from the hub and capable of deflecting toward the hub when force is applied to the traction element. The traction element engages grass blades and provides traction while minimizing harm to the turf. In particular, enhanced traction is provided due to grass blades becoming trapped between the cantilevered arm and the sole of the shoe when the traction element bends toward the sole, resulting in a temporary mechanical locking of he shoe to the grass. The deflection feature of the cleat of the McMullin '641 patent further minimizes wear of the cleat when engaging a hard surface such as concrete.

While the cleat described in the McMullin '641 patent is effective in providing enhanced traction, minimal damage to the turf, and minimized wear of the cleat on hard surfaces, it is noted that the traction developed by the trapping of blades of grass between the cantilevered arm of the cleat and the sole of the shoe is limited to a substantially planar engagement. In other words, when the cleat is deflected, the surfaces of the arm and the sole that engage and trap blades of grass are generally parallel to each other such that the engaged portion of each blade of grass generally occupies a single plane. In such a trapped environment, the possibility exists for blades of grass to frictionally slide between the engaging surfaces of the cleat and shoe sole if the shoe begins to slide along the turf while the cleat is in the deflected position.

It is therefore desirable to provide a shoe cleat with enhanced traction that is capable of trapping and firmly engaging blades of grass while preventing any frictional sliding of the trapped blades with respect to the shoe.

OBJECTS AND SUMMARY OF THE INVENTION

Therefore, in light of the above, and for other reasons that become apparent when the invention is fully described, an object of the present invention is to provide a shoe cleat with enhanced traction while minimizing damage to turf surfaces.

It is another object of the present invention to provide a shoe cleat that does not easily wear on hard surfaces such as concrete or asphalt.

It is a further object of the present invention to provide a shoe cleat that is capable of deflecting to temporarily engage and trap blades of grass upon contact with the turf while preventing the trapped blades of grass from sliding during such temporary engagement.

The aforesaid objects are achieved individually and in combination, and it is not intended that the present invention be construed as requiring two or more of the objects to be combined unless expressly required by the claims attached hereto.

In accordance with the present invention, an improved traction cleat is provided including a hub and at least one traction element extending from the hub and away from the sole of a shoe when the cleat is secured to the shoe sole. The traction element is configured to deflect toward the shoe sole to trap and frictionally engage blades of grass in a non-planar engaging area disposed between the traction element and the shoe. The non-planar engagement and trapping of the blades of grass by the shoe cleat firmly secures the shoe to the grass blades and prevents sliding of the shoe on the turf.

Further, in order to minimize damage to golf greens, the invention provides for configuring the foot, or turf contacting portion, of each traction element smoothly convex to facilitate sliding of the foot along a golf green as the traction elements flex outwardly under the weight of the wearer of the shoe.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION OF PREFERRED EMBODIMENTS

The present invention includes a shoe cleat and connector providing enhanced traction while minimizing damage to a turf surface to which the cleat is applied and reducing wear to the cleat when engaging a hard surface. While the embodiments described below depict a single shoe cleat secured to a connector disposed in the sole of a shoe, it is noted that any suitable number of shoe cleats may be provided on the sole of a shoe in any selected pattern or array to obtain a desired traction of the shoe on a particular turf surface.

Figure 1:
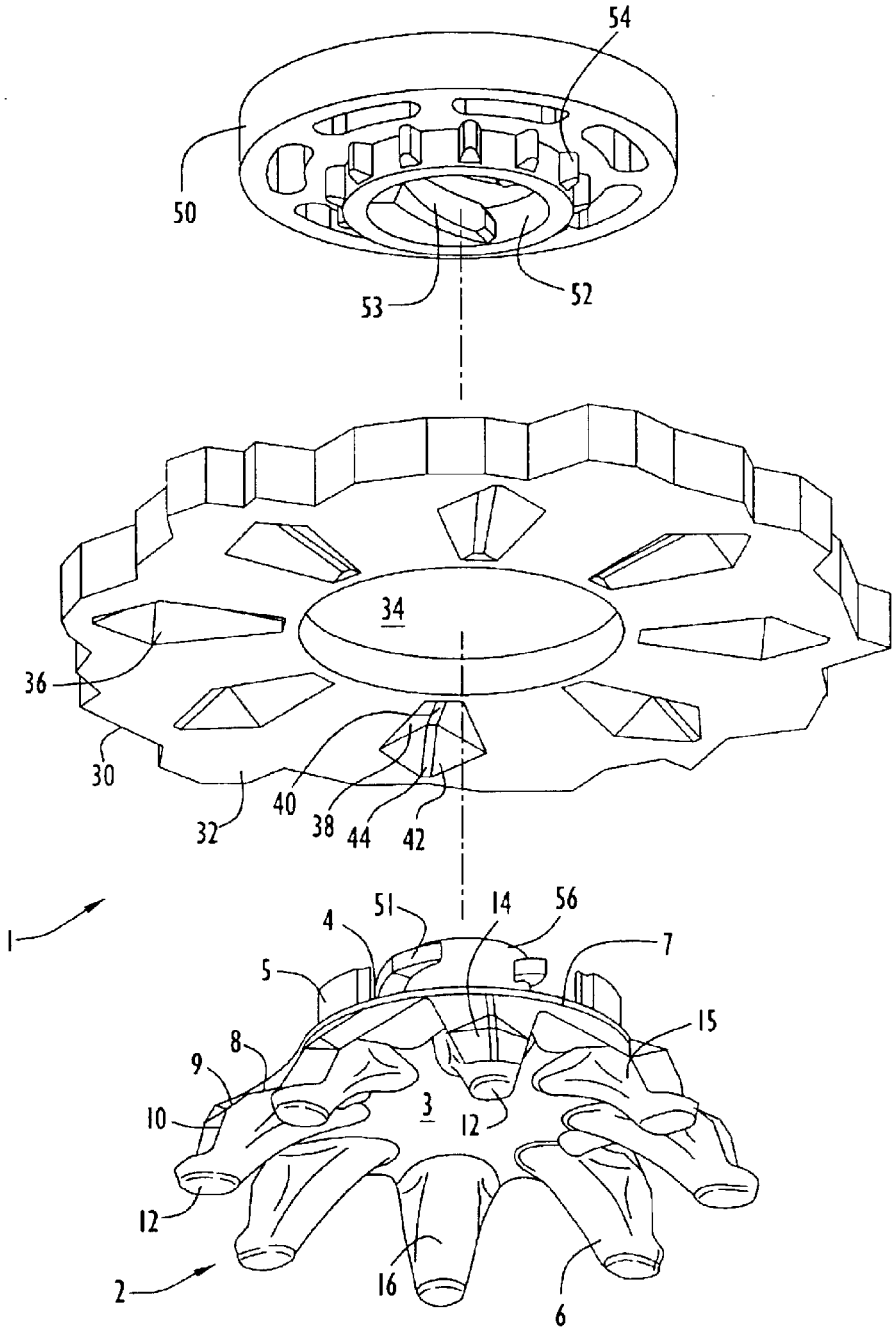
FIG. 1 is an exploded view in perspective and from below of a shoe cleat including connector in accordance with the present invention.
Figure 2:
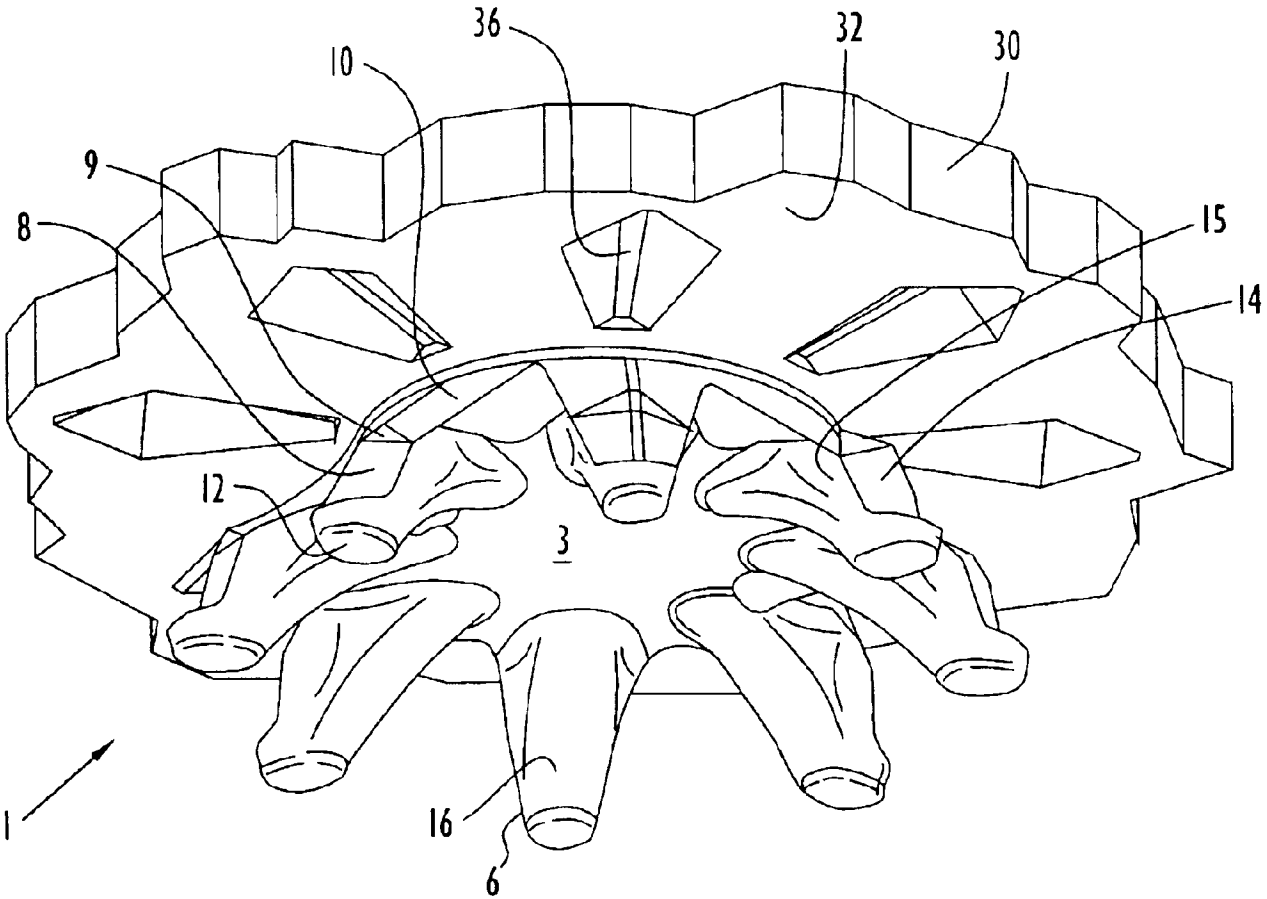
FIG. 2 is a bottom view in perspective of the shoe cleat of FIG. 1.
Figure 3:
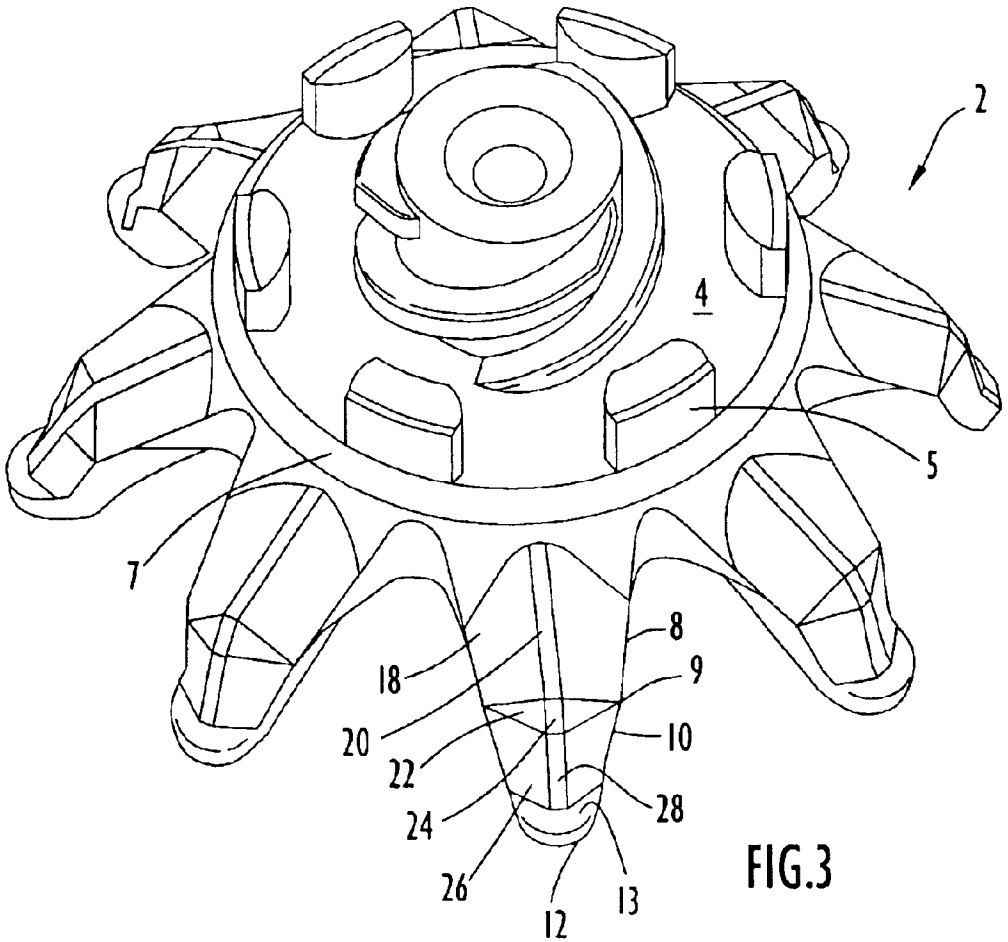
FIG. 3 is a top view in perspective of the cleat of the shoe cleat of FIG. 1.

Referring to FIGS. 1–3, a shoe cleat assembly 1 includes a cleat 2 and a base 30, both of which are secured to a receptacle connector 50 disposed within a suitable recess in a shoe sole. For purposes of convenience and clarity, the connector 50 is not depicted within the sole in FIG. 1. The cleat 2 includes a generally circular hub 7 having a bottom surface 3 and a top surface 4. It is to be understood that the terms "top surface" and "bottom surface" as used herein refer to surfaces of the shoe cleat that face toward or away, respectively, from the connector that secures the shoe cleat to the shoe sole. Traction elements 6 are deflectably secured to the hub 7 and extend away from the bottom surface 3 in a manner described below. The cleat, base and connector may be made of any one or more suitable materials (e.g., plastic, metal, etc.). Preferably, the traction elements are made of a suitable resiliently flexible material (e.g., an elastomer or any other suitably resilient plastic) to permit a desired degree of deflection toward the shoe sole upon engaging a surface.

Extending from the top surface 4 of the cleat are locking posts 5 that mate and releasably engage with locking projections 54 disposed on the outside of an internally threaded receptacle 52 of the connector 50 so as to releasably secure the shoe cleat to the shoe sole. The internal threads 53 of receptacle 52 engage threads 51 disposed on the outer surface of a cleat post 56. This connecting mechanism is substantially similar in design and operation to the shoe cleat connector described in U.S. Pat. No. 5,974,700 to Kelly, the disclosure of which is incorporated herein by reference in its entirety. However, it is noted that the cleat connector and connection elements on the cleat form no part of the present invention, and any connector design capable of securing the shoe cleat to the sole of a shoe may be utilized including, without limitation, the threaded screw cleat connector design described in the McMullin '641 patent. A further example of a connector arrangement that may be employed is substantially similar to the arrangement described in co-pending U.S. patent application Ser. No. 09/987,238, filed Nov. 14, 2001 by Kelly et al. and entitled "Studded Footware", where the final rotational position of the cleat relative to the receptacle is predetermined. The disclosure of that patent application is incorporated herein by reference in its entirety. Alternatively, the cleat may directly engage the sole of the shoe.

Base 30 includes an irregular, non-circular shaped disk including an outer perimeter formed by a series of consecutively connected multifaceted surfaces. The perimeter geometry of the base may correspond with the outer perimeter of the receptacle of the shoe sole in which the connector 50 is nested such that, upon proper alignment and insertion of base 30 within the sole receptacle, a bottom surface 32 of the base is substantially flush with the bottom surface of the sole and is incapable of rotational movement with respect to the sole. The base further includes a substantially circular aperture 34 defined axially through the base and aligned and sufficiently dimensioned to permit the connecting elements of the cleat and receptacle to engage one another. Specifically, the base aperture 34 is suitably dimensioned to permit insertion of threaded cleat post 56 and locking posts 5 through such aperture so as to appropriately engage the connector and retain the cleat and base to the shoe sole. A series of recesses 36 are defined in and along the bottom surface 32 of the base surrounding the opening 34. The recesses 36 are preferably multifaceted and are angularly aligned about the central longitudinal axis of the base to receive deflecting traction elements 6 of the cleat in a manner described below.

The base 30 illustrated in FIG. 1 is separate from the cleat and the connector. However, it is noted that the base may be molded to be integral with either the cleat or the connector. It is further noted that the base may also be integral with the sole of the shoe. In such an embodiment, the receptacle of the shoe sole is substantially similar in dimension with the aperture 34 of the base 30 depicted in FIG. 1, and the multifaceted recesses are disposed around the receptacle and suitably aligned to receive deflecting traction elements of the cleat in the manner described below. When the base 30 is not integral or otherwise positionally fixed to the cleat 2, the locking arrangement between the cleat 2 and connector 50 must be such as to assure alignment of traction elements 6 with recesses 36 when the cleat has been rotationally locked in place in the receptacle 50. Such an arrangement is disclosed, for example, in the aforementioned Kelly et al. patent application. If the base and cleat are positionally fixed to one another, the locking arrangement need not provide for a predetermined final orientation of the cleat relative to the connector.

Cleat 2 includes a plurality of cantilevered traction elements 6 circumferentially spaced along the outer perimeter of the hub 7 and extending in a direction downwardly and outwardly away from the bottom surface 3. The traction elements are constructed of a suitable resilient and flexible material such that, when an appropriate amount of force is applied to the bottom of the cleat (e.g., when the shoe is forced against a turf surface), the cantilevered traction elements pivot and are flexed toward the shoe sole and are at least partially received in the recesses 36 of the base 30. When force is removed from the bottom of the cleat (e.g., when the shoe is lifted from the turf surface), the traction elements resiliently deflect back to their initial or original unstressed position. For illustrative purposes, eight traction elements 6 are depicted in FIGS. 1–3, and eight corresponding multifaceted recesses 36 are disposed on the base 30 and aligned with the traction elements. However, it is noted that any suitable number of traction elements (e.g., one or more) and corresponding recesses may be utilized in accordance with the present invention to obtain a desirable traction and non-planar engagement with blades of grass when the traction elements are deflected as described below.

Each traction element 6 includes a base section 8 extending outward at an obtuse angle (e.g., about 140–160°) from the bottom surface of the hub 7, a medial section 9 extending at an obtuse angle (e.g., about 140–160°) from the base section 8, and a distal section 10 extending at an obtuse angle (e.g., about 140–160°) from the medial section 9 and terminating in a foot 12. The medial section is substantially shorter in longitudinal dimension than each of the base and distal sections, and the distal section is shorter in longitudinal dimension than the base section. Each foot 12 has a convex, generally elliptical, periphery with a major axis aligned along an imaginary axis that intersects a central longitudinal axis passing perpendicularly through the hub 7. Each foot 12 further extends along its major axis beyond the distal section to which it is attached and away from and beyond the outer perimeter of the hub 7. The traction elements 6 are preferably all substantially similarly dimensioned such that, when each traction element 6 is at rest (i.e., not deflected toward the shoe sole), the lowermost points on all of the feet 12 define an imaginary plane that is substantially parallel to the plane of the bottom surface of hub 7, and the combined centers of all the feet are disposed on an imaginary circle that resides in the imaginary plane and has the hub longitudinal axis passing perpendicularly through its center. The bottom surface of each foot 12 is configures smooth and convex to minimize impact of the cleat on a turf surface as described below.

The base section 8, medial section 9 and distal section 10 of each traction element 6 combine to form an exterior surface portion 14 facing generally upwardly and outwardly away from the longitudinal axis of hub 7. An interior surface portion 16 faces generally downwardly and inwardly toward that axis, and side surfaces 15 connect the interior and exterior surface portions to form the remaining peripheral surface area of each traction element. The interior surface portions 16 are preferably smooth and include no corners or edges, whereas the exterior surface portions 14 are preferably multifaceted, the facets intersecting in a plurality of corners or edges.

Each interior surface portion 16 forms a generally concave surface extending from the bottom surface 3 of the hub to a corresponding foot 12 such that a spatial area generally defined by the combined interior surface portion areas of the cleat 2 forms an imaginary solid curved figure. For example, in the illustrated embodiment of FIGS. 1–3, when each of the traction elements is at rest (i.e., not deflecting toward the shoe sole), the spatial area at least partially defined by the combined interior surface portion areas of the cleat has the configuration of a segment of a sphere. Alternatively, the combined interior surface portion areas may form any suitable curved or polyhedral geometry including, without limitation, a segment of an ovoid, or a paraboloid, or a polyhedron. It will be appreciated that, upon deflection of any of the traction elements toward the shoe sole, the spatial geometry at least partially defined between the combined interior surface portion areas of the traction elements will change; however, despite the change, the spatial geometry will remain the similar but with a larger diametric dimension. This feature is particularly important when utilizing the shoe cleat on certain turf surfaces, as the smooth geometry within the interior of the cleat softens contact between the cleat and grass blades disposed between the traction elements as the cleat is pressed upon the turf.

The exterior surface portions 14 of the traction elements 6 are substantially similar, with each portion including three sets of facets intersecting at linear junctions along the exterior surface portion such that the exterior surface portion resembles a section of a polyhedron. The facets are further configured such that the exterior surface is symmetrical along its major dimension. Each set includes three facets aligned with respect to each other as described below. While FIGS. 1–3 depict the facets on the exterior surface portion of the traction elements 6 and corresponding facets in the recesses 36 of the base 30 as being generally planar, it is noted that these facets may also be curved in any suitable manner (e.g., concave or convex). Thus, the term "facet" as used herein refers to both planar and non-planar surfaces. In addition, it is noted that the exterior surface geometries of the traction elements and the interior surface geometries of the recesses are not limited to the depiction in FIGS. 1–3. Rather, any suitable symmetrical or asymmetrical multifaceted exterior traction element geometry and/or interior recess geometry may be provided, and the exterior or interior surface geometries of any two or more traction elements and/or recesses may vary. An important feature that must be retained, irrespective of the chosen surface geometry or shape, is the ability of the traction element to cooperate with the base, sole or other member to bend, crimp or force into any other non-planar configuration blades of grass in the manner described below.

Referring to FIG. 3, the exterior facets of a first set of each traction element 6 define the exterior of the base section 8 and extend longitudinally from the hub 7 toward a second set. The facets of the second set define the exterior of the medial section 9. Two generally tetragonal facets 18 of the first set are disposed on either side of a generally rectangular central facet 20, with the facing longitudinal edges of facets 18 forming linear junctions with the opposing edges of the central facet 20. The tetragonal facets 18 of the first set further extend in a direction transverse their major or longitudinal dimensions and at substantially similar obtuse angles (e.g., about 120–170°) from the central facet 20 to terminate at opposing peripheral edges of the base section 8. The second set of facets of the medial section 9 includes two generally triangular facets 22 forming linear junctions at facing edges with the opposing edges of a generally rectangular central facet 24. The triangular facets 22 extend from the opposing edges of the central facet 24 at substantially similar obtuse angles (e.g., about 120–170°) to form apexes disposed on opposing peripheral edges of the medial section 9. Each of the triangular facets 22 of the second set also includes an upper edge that forms a linear junction with a lower edge of a corresponding tetragonal facet 18 of the first set. Similarly, the upper edge of central facet 24 of the second set forms a linear junction with the lower edge of central facet 20 of the first set.

The third set of facets defines the exterior of the distal section 10 of each traction element 6 and includes two generally tetragonal facets 26 disposed on either side of a generally rectangular central facet 28, with the facing longitudinal edges of the tetragonal facets 26 forming linear junctions with the opposing edges of the central facet 28. Tetragonal facets 26 of the third set extend in a direction transverse their longitudinal dimensions and at substantially similar obtuse angles (e.g., about 120–170°) from the central facet 28 to terminate at opposing peripheral edges of the distal section 10. Each tetragonal facet 26 further extends longitudinally from a linear junction at a lower edge of a corresponding triangular facet 22 of the second set to a top surface 13 of the foot 12. Similarly, the central facet 28 of the third set extends from a lower edge of the central facet 24 of the second set to the top surface 13 of the foot 12.

Each recess 36 disposed on the base 30 is defined by a series of facets that are suitably aligned in a complimentary geometric configuration with respect to the first and second sets of facets disposed on the base section 8 and medial section 9 of the traction elements 6 such that the facets of the recess engage the first and second facets of a corresponding traction element 6 when the traction element is deflected at least partially into the recess as described below.

Each recess 36 also includes two sets of generally planar facets that are substantially symmetrical along a longitudinal dimension of the recess. Referring again to FIG. 1, a first set of facets extends from a section of the recess lying proximate base opening 34 and includes two generally tetragonal surfaces 38 separated by a generally rectangular central facet 40 disposed at a first bottom section of the recess, with the facing longitudinal edges of tetragonal facets 38 forming linear junctions with the opposing edges of the central facet 40. The tetragonal facets 38 of the first set of each recess further extend in a direction transverse their longitudinal dimensions and at substantially similar obtuse angles from the central facet 40 to terminate at opposing peripheral edges of the recess. The angle at which each tetragonal facet 38 extends from central facet 40 is substantially similar to the angle at which the tetragonal facets 18 of each of the traction elements 6 extend from their respective central facet 20. Thus, the first set of facets of each recess 30 basically compliments the first set of facets of each traction element 6 such that the tetragonal facets 18 and central facet 20 align and substantially engage with corresponding tetragonal facets 38 and central facet 40 when the traction element is deflected into the recess.

The second set of recess facets forms the remainder of each recess and includes two generally triangular facets 42 separated by a generally rectangular central facet 44 disposed at a second bottom section of the recess, with the facing edges of the triangular facets 42 forming linear junctions with opposing edges of the central facet 44. The triangular facets 42 extend from the opposing edges of the central facet 44 at substantially similar obtuse angles to form apexes disposed on peripheral edges of the recess 36. The angle at which each triangular facet 42 extends from central facet 44 is substantially similar to the angle at which the triangular facets 22 of the medial section 9 of each traction element 6 extend from their respective central facet 24. An edge of each triangular facet 42 of the second set forms a linear junction with a corresponding edge of a tetragonal facet 38 of the first set, whereas an edge of the central facet 44 of the second set forms a linear junction with a corresponding edge of the central facet 40 of the first set. Each recess facet in the second set further extends from a respective recess facet of the first set at an angle substantially similar to the angle at which the medial section 9 extends from the base section 8 of each traction element 6. Thus, the second set of facets of each recess 30 forms a geometric configuration and spatial alignment that substantially compliments the second set of facets of each traction element 6. In addition, the second set of facets of each recess is suitably dimensioned to receive at least a portion of the third set of facets of the distal section 10 of each traction element. When the traction elements are at fully deflected positions with respect to the shoe sole, the first and second sets of facets of the base and medial sections of each traction element are completely received within a corresponding recess and engage with the first and second sets of recess facets to provide a non-planar engaging area for blades of grass trapped between the traction element and recess. In such fully deflected position, at least a portion of the third set of facets of the distal section of each traction element is also received within the corresponding recess, while the feet 12 of each traction element remain removed from the recesses.

In operation, the cleat 2 and base 30 are oriented such that, when the cleat is locked in receptacle 50, each of the traction elements 6 is aligned with a corresponding recess 36 disposed on the base 30.

Figure 4A:
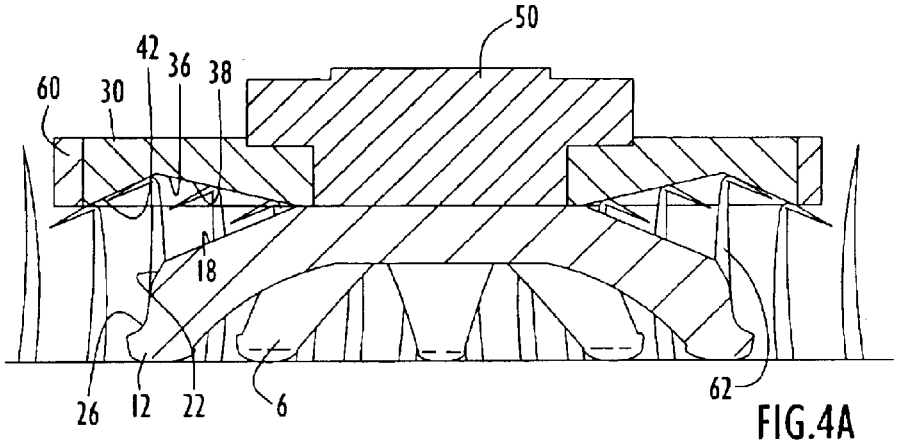
FIGS. 4*a*–4*c* are side cross-sectional views of the shoe cleat of FIG. 1 connected to the sole of a shoe at rest and in deflected positions with blades of grass trapped by the shoe cleat.
Figure 4B:
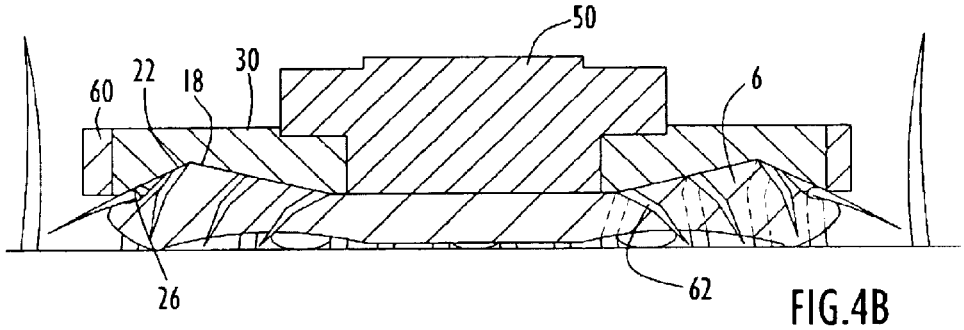
Figure 4C:
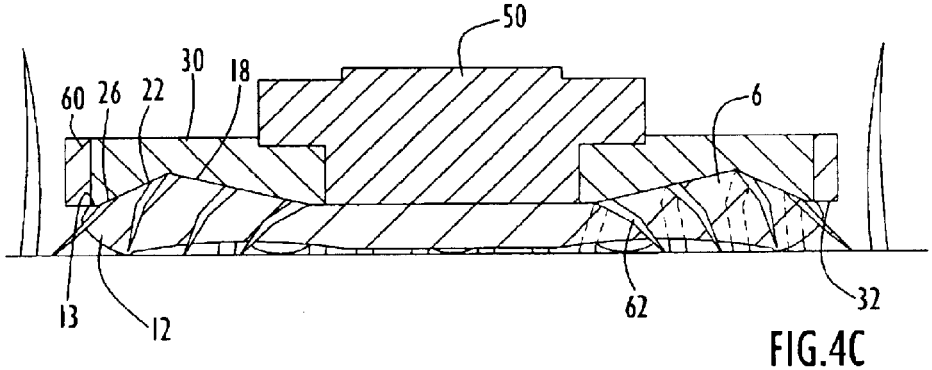

Deflection of the traction elements toward the base or shoe sole under the weight of the wearer of the shoe is illustrated in FIGS. 4*a*–4*c*. These figures depict a cross-section of the cleat 1 and a shoe sole 60 to which the cleat is attached, where the traction elements 6 are initially at rest in an initial or original position (FIG. 4*a*) and then deflected to positions where the traction elements are at least partially received in and engage respective recesses 36 to trap and secure blades of grass 62 (FIGS. 4*b* and 4*c*). Specifically, as the shoe is brought down against a turf surface, forces are applied to feet 12 of the cleat 2, resulting in a deflection of the traction elements 6 in a direction toward shoe sole 60 and base 30. The exterior surfaces 14 of the traction elements are brought into engaging contact with recesses 36, where the first and second sets of exterior facets 18, 20, 22, 24 of each traction element engage the first and second sets of facets 38, 40, 42, 44 of a corresponding recess. In other words, the exterior surface portions of the base and medial sections 8, 9 of the traction elements 6 engage with corresponding surface portions of the recesses 30. Grass blades 62 disposed on the turf at a location between a traction element and a corresponding recess are forced into the recess by the traction element, where they become bent or crimped by the combination of the engaging multifaceted geometries of the traction elements and the recesses.

At the point of deflection depicted in FIG. 4*b*, the exterior of the base and medial sections 8, 9 of each traction element 6 has substantially engaged with a corresponding recess 36 on base 30 to retain grass blades 62 between the cleat and the shoe in a non-planar engagement. However, the third set of facets 26, 28 disposed on the distal sections 10 of the traction elements remain separated from the second set of facets 42, 44 of the recesses due to the distal sections extending at obtuse angles from their medial sections 9.

Optionally, the cleat may be configured to provide an enhanced cushioning effect, where the traction elements further deflect from the position in FIG. 4*b* to the position in FIG. 4*c*. Referring to FIG. 4*c*, the cushion effect is realized when sufficient force is applied to the cleat to pivot each distal section 10 slightly with respect to its medial section 9 in a direction toward the recess such that facets 26, 28 of the traction element engage with exposed portions of facets 42, 44 of the recess. In other words, the traction elements are resiliently flexible enough to absorb some of the force applied by the shoe by further deflecting toward the shoe sole until the top surface 13 of each foot 12 engages the bottom surface 32 of the base 30.

As is evident from FIGS. 4*b* and 4*c*, the crimping or bending of grass blades, which is caused by the deflecting action of the traction elements, results in a non-planar frictional locking engagement of the grass blades by the cleat thus providing enhanced traction to the shoe. This locking engagement is removed upon lifting of the shoe from the turf surface, thereby removing the deflecting forces and resulting in return of the traction elements to their initial or original positions and release of grass blades trapped by the cleat.

The curved interior surface portions 16 of the traction elements provide a soft engaging contour for grass blades disposed between the traction elements when the cleat contacts the turf surface. Additionally, the curved, convex bottom surfaces of the feet 12 minimize or prevent penetration of the feet into the turf during contact. The curvature of the bottom surfaces may be selected to permit the traction elements to slide along rather than dig into or penetrate the turf surface when the shoe is brought down upon the turf. This is a significant improvement over other cleats known in the art that have substantially planar bottom turf engaging surfaces that penetrate the turf. The convex bottom surfaces of the feet further facilitate easy sliding and deflection of the traction elements on hard surfaces (e.g., concrete or asphalt) while minimizing wear and tear of the cleat on such surfaces.

The crimping or bending of grass blades by the cleat to achieve a non-planar engaging surface of the grass blades between the traction elements and the base/sole of the shoe can be achieved by a variety of other cleat embodiments in accordance with the present invention. Alternative cleat and base/shoe sole embodiments include, without limitation, providing multifaceted exterior surfaces for the traction elements that engage with smooth concave recesses or convex surfaces, providing smooth exterior surfaces for the traction elements that engage with multifaceted recesses, and providing multifaceted exterior surfaces for the traction elements that engage with substantially smooth and nonplanar base or shoe sole surfaces. Basically, any combination of exterior traction element surface and corresponding base or shoe sole surface that provides a non-planar contact or engaging area for trapping and securing blades of grass during contact of a cleat with a turf surface is contemplated in accordance with the present invention.

Figure 5:
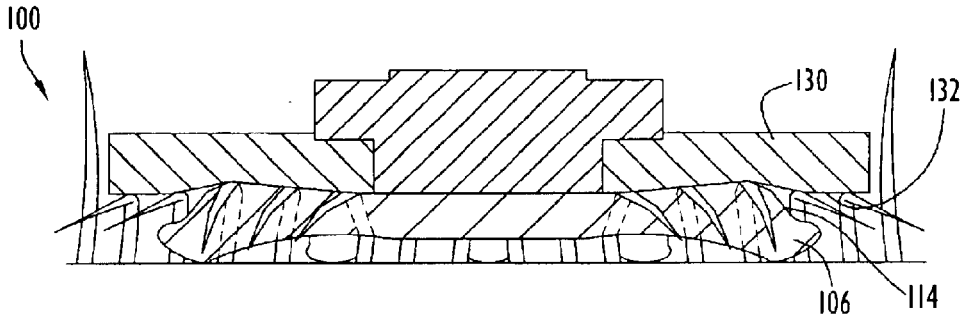
FIG. 5 is a side cross-sectional view of an alternative embodiment of a shoe cleat connected to the sole of a shoe and in a deflected position with blades of grass trapped by the shoe cleat.

Some examples of alternative embodiments that provide a non-planar engaging geometry between the traction elements and the base or shoe sole are illustrated in FIGS. 5–9. In the embodiment of FIG. 5, a cleat 100 is depicted with traction elements 106 having exterior surface portions 114 substantially similar in geometric configuration to the traction elements for the previous embodiment described above and illustrated in FIGS. 1–3. However, there are no corresponding recesses provided in the base or shoe sole 130. In this embodiment, a crimping or bending of grass blades 162 is realized upon sufficient deflection of the traction elements 106 against cushion-like base or shoe sole 130 such that a portion of the multifaceted exterior surface 114 of each traction element forms a slight resilient indentation in the surface of the base or sole. The base or sole 130 preferably includes an engaging surface 132 constructed of a suitable flexible and resilient material that easily accommodates such indentations caused by the deflecting traction elements and returns to an original relaxed position upon separation of the traction elements from the engaging surface 132.

Figure 6:
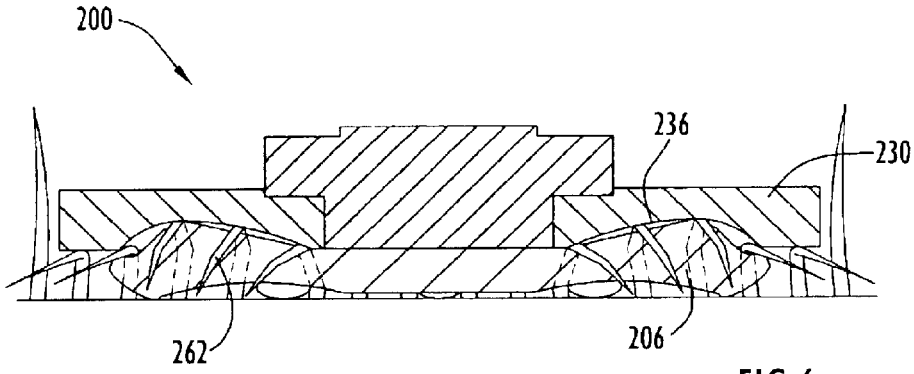
FIG. 6 is a side cross-sectional view of a third alternative embodiment of a shoe cleat connected to the sole of a shoe in accordance with the present invention, where the shoe cleat is in a deflected position with blades of grass trapped by the shoe cleat.

The cleat embodiment 200 of FIG. 6 is substantially similar to the embodiment described above and illustrated in FIGS. 1–3, except that the recesses 236 of the base or sole 230 are substantially smooth and concave rather than multifaceted. The grass blades 262 are still crimped as they are pressed against recesses 236 by traction elements 206.

Figure 7:
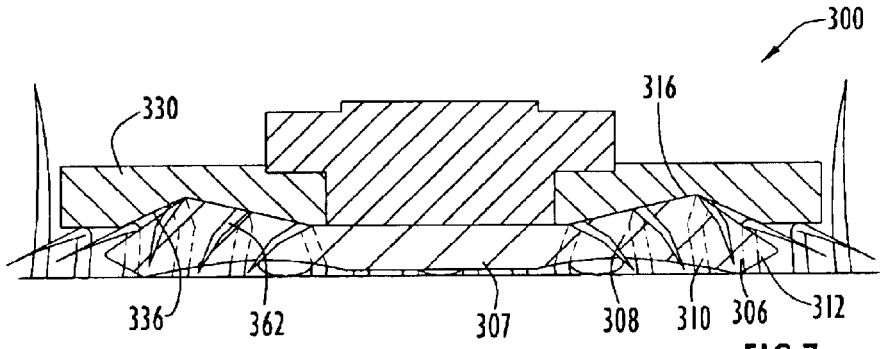
FIG. 7 is a side cross-sectional view of a fourth alternative embodiment of a shoe cleat connected to the sole of a shoe in accordance with the present invention, where the shoe cleat is in a deflected position with blades of grass trapped by the shoe cleat.

In the cleat embodiment of FIG. 7, cleat 300 includes traction elements 306 that are substantially similar to the traction elements disclosed in the McMullin '641 patent and have exterior surface portions 316 that are generally smooth rather than having multiple facets. Each traction element 306 includes a base section 308 extending at an obtuse angle from a hub 307 and a distal section 310 extending at an obtuse angle from the base section and terminating at a foot 312. The exterior surface portions of each of the base and distal sections are configured with a generally planar tetragonal geometry. The base or shoe sole 330 includes multifaceted recesses 336 that are similar to the recesses described above and illustrated in FIGS. 1 and 2. When the traction elements 306 deflect into the recesses 336, grass blades 362 which are trapped in the recesses are crimped and locked at engaging locations where the exterior surface portions 314 of the traction elements contact the multiple facets of the recesses.

Figure 8:
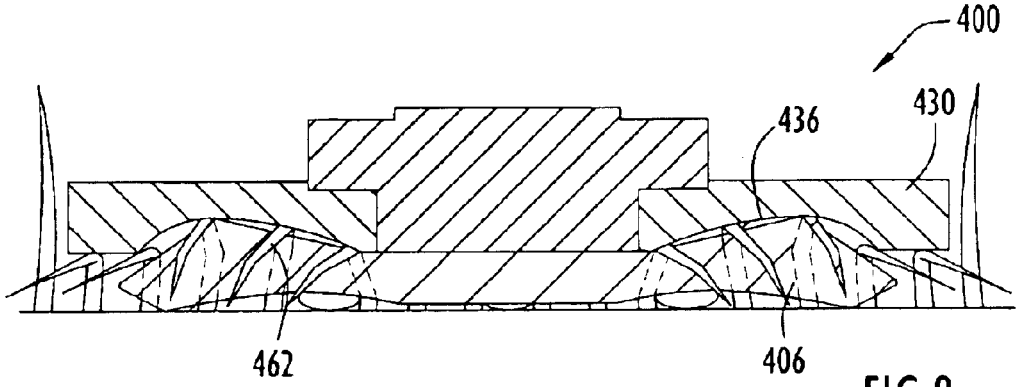
FIG. 8 is a side cross-sectional view of a fifth alternative embodiment of a shoe cleat connected to the sole of a shoe in accordance with the present invention, where the shoe cleat is in a deflected position with blades of grass trapped by the shoe cleat.

The cleat embodiment 400 of FIG. 8 is substantially similar to FIG. 7, except that the recesses 436 on the base or shoe sole 430 have smooth and concave surfaces instead of multifaceted surfaces. The grass blades 462 are still crimped upon deflection of the traction elements 406 into the recesses 436, because the grass blades 462 are forced by the traction elements against the non-planar contour of the recesses.

Figure 9:
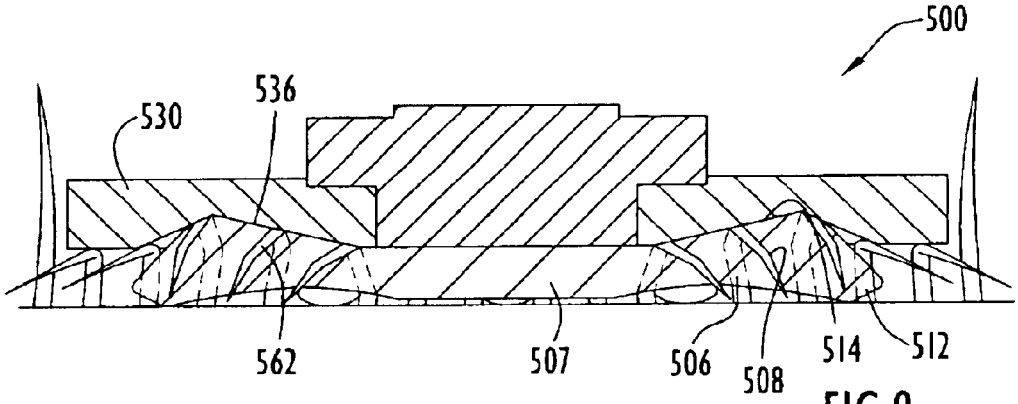
FIG. 9 is a side cross-sectional view of a sixth alternative embodiment of a shoe cleat connected to the sole of a shoe in accordance with the present invention, where the shoe cleat is in a deflected position with blades of grass trapped by the shoe cleat.

The cleat embodiment 500 of FIG. 9 is similar to the embodiment described above and illustrated in FIGS. 1–3, with the traction elements 506 including multifaceted exterior surface portions 514 and the base or shoe sole 530 including multifaceted recesses 536. However, rather than having base, medial and distal sections extending at obtuse angles from each other, each of the traction elements includes a single section 508 extending from hub 507 to a foot 512. As is evident from FIG. 9, crimping of grass blades 562 is still accomplished in this embodiment when the traction elements 506 are deflected up into corresponding recesses 536.

In all of the embodiments described herein, the feet (12, 312, 512, etc.) of the traction elements have a smoothly (i.e., uninterrupted by edges, corners, etc.) contoured convex configuration to facilitate sliding of the feet along a surface such as a golf green as the traction elements are flexed outwardly under the weight of the wearer of the golf shoe. This feature eliminates any penetrating, puncturing or indenting of the green by the traction element feet.

Having described preferred embodiments of shoe cleats with improved traction, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A cleat securable to a sole of a shoe for providing traction for the shoe on a turf surface including blades of grass extending from the turf surface, the cleat comprising:

a hub with an exposed surface facing away from the shoe sole when the cleat is secured to the shoe and at least one resiliently flexible traction element extending from the hub in a direction away from the exposed surface of the hub;

wherein the traction element is resiliently deflectable toward the shoe sole when the shoe is forced against the turf surface and is configured to engage and secure grass blades in a non-planar engaging surface area disposed between the traction element and the shoe when the traction element is deflected toward the shoe sole; and wherein the traction element includes a foot disposed at a distal end of the traction element, the foot including an exposed surface that is substantially convex to engage the turf surface when the shoe is forced against the turf surface.

2. The cleat of claim 1, wherein the engaging surface area is defined by a geometric configuration selected from the group consisting of a curved geometry, a multifaceted geometry, and combinations thereof.

3. The cleat of claim 2, wherein the engaging surface area is disposed between a non-planar engaging surface portion of the traction element and an engaging portion of the shoe sole.

4. The cleat of claim 1, further comprising a base surrounding the hub and including an exposed surface substantially flush with the shoe sole when the cleat is secured to the shoe, wherein the engaging surface area is disposed between an engaging surface portion of the traction element and an exposed surface portion of the base.

5. The cleat of claim 4, wherein the exposed surface portion of the base includes a recess to receive at least part of the engaging surface portion of the traction element when the traction element deflects toward the shoe sole.

6. The cleat of claim 5, wherein the engaging surface portion of the traction element is non-planar and includes a geometry selected from the group consisting of at least one curved surface, a plurality of multifaceted surfaces, and combinations thereof.

7. The cleat of claim 6, wherein a geometry of the recess at least partially corresponds with the geometry of the engaging surface portion of the traction element.

8. The cleat of claim 5, wherein the engaging surface portion of the traction element is substantially planar and the geometry of the recess is selected from the group consisting of at least one curved surface, a plurality of multifaceted surfaces, and combinations thereof.

9. The cleat of claim 1, wherein the at least one traction element comprises a plurality of traction elements.

10. The cleat of claim 9, wherein the traction elements are disposed along a perimeter of the hub and deflect in a direction away from a center of the hub, each traction element including a substantially smooth interior surface portion facing the hub center.

11. The cleat of claim 10, wherein the interior surface portion of each traction element is concave and the combined interior surface portions at least partially define a parabolic surface.

12. The cleat of claim 1, wherein the traction element is further configured to crimp the grass blade upon being deflected toward the shoe sole.

13. A shoe for providing traction on a turf surface including blades of grass extending from the turf surface, the shoe comprising:

a sole; and at least one cleat secured to the sole, the cleat comprising a hub with an exposed surface facing away from the sole and at least one resiliently flexible traction element extending from the hub in a direction away from the exposed surface of the hub;

wherein the traction element is resiliently deflectable toward the sole when the shoe is forced against the turf surface and is configured to engage and secure grass blades in a non-planar engaging surface area disposed between the traction element and the sole when the traction element is deflected toward the sole; and wherein the traction element includes a foot disposed at a distal end of the traction element and having an exposed surface that is substantially convex to engage the turf surface when the shoe is forced against the turf surface.

14. The shoe of claim 13, wherein the cleat includes a base surrounding the hub and disposed within a receptacle of the sole such that an exposed surface of the base is substantially flush with the sole, and the engaging surface area is disposed between the traction element and the exposed surface of the base.

15. The shoe of claim 13, wherein the engaging surface area is defined by a geometric configuration selected from the group consisting of a curved geometry, a multifaceted geometry, and combinations thereof.

16. The shoe of claim 13, wherein the engaging surface area is defined by a non-planar engaging surface portion of the traction element, the non-planar engaging surface portion including a geometry selected from the group consisting of multifaceted surfaces, a curved surface, and combinations thereof.

17. The shoe of claim 16, wherein the sole includes a resiliently flexible portion that engages with the engaging surface portion of the traction element when the traction element is deflected toward the sole such that the flexible portion deforms to substantially correspond with at least part of the non-planar engaging surface portion of the traction element.

18. The shoe of claim 13, wherein the sole includes at least one recess aligned to receive at least part of the non-planar engaging surface portion of the traction element when the traction element is deflected toward the sole.

19. The shoe of claim 18, wherein the recess includes a geometry that at least partially corresponds with the geometry of the engaging surface portion of the traction element.

20. The shoe of claim 13, wherein the traction element includes a substantially planar engaging surface portion and the sole includes a recess aligned with the traction element to receive at least part of the engaging surface portion when the traction element is deflected toward the sole.

21. The shoe of claim 20, wherein the recess includes a geometry selected from the group consisting of a plurality of multifaceted surfaces, at least one curved surface, and combinations thereof.

22. The shoe of claim 13, wherein the at least one traction element comprises a plurality of traction elements.

23. The shoe of claim 22, wherein the traction elements are disposed along a perimeter of the hub and deflect in a direction away from a center of the hub, each traction element including a substantially smooth interior surface portion facing the hub center.

24. The shoe of claim 23, wherein the interior surface portion of each traction element is concave and the combined interior surface portions at least partially define a parabolic surface.

25. The shoe of claim 13, wherein the at least one cleat comprises a plurality of cleats secured at selected locations along the sole.

26. The shoe of claim 13, wherein the traction element is further configured to crimp the grass blade within the engaging surface area upon being deflected toward the sole.

27. The shoe of claim 13, further comprising:

a connector disposed within a receptacle of the sole; and wherein the cleat includes a connecting member disposed on a connecting surface of the hub that opposes the hub exposed surface, wherein the connecting member engages with the connector to secure the cleat to the sole.

28. A method of providing traction for a shoe on a turf surface including blades of grass utilizing a cleat secured to a sole of the shoe, the cleat including a hub with an exposed surface facing away from the shoe sole and at least one resiliently flexible traction element extending from the hub in a direction away from the hub exposed surface, the traction element including a foot disposed at a distal end of the traction element the method comprising:

(a) forcing the shoe against the turf surface;

(b) in response to the forcing of the shoe against the turf surface, resiliently deflecting the traction element from an initial position toward the sole to engage and secure grass blades in a non-planar engaging surface area disposed between the traction element and the sole; and (c) engaging the turf surface with an exposed surface of the foot when the shoe is forced against the turf surface, the exposed surface of the foot being substantially convex.

29. The method of claim 23, further comprising:

(d) removing the shoe from the turf surface; and (e) in response to removal of the shoe from the turf surface, deflecting the traction element back to the initial position to release the grass blade from the engaging surface area.

30. The method of claim 28, wherein the cleat further includes a base disposed within a receptacle of the sole with an exposed surface of the base being substantially flush with the sole, and the engaging surface area is disposed between the traction element and the exposed surface of the base.

31. The method of claim 28, wherein the engaging surface area is defined by a geometric configuration selected from the group consisting of a curved geometry, a multifaceted geometry, and combinations thereof.

32. The method of claim 28, wherein the engaging surface area is defined by a non-planar engaging surface portion of the traction element, the non-planar engaging surface portion including a geometry selected from the group consisting of multifaceted surfaces, a curved surface, and combinations thereof.

33. The method of claim 32, wherein the sole includes a resiliently flexible portion aligned with the engaging surface portion of the traction element, and the method further comprises:

(d) deforming the flexible portion to at least partially correspond with the non-planar engaging surface portion of the traction element upon deflection of the traction element toward the sole.

34. The method of claim 32, wherein the sole includes at least one recess aligned with the fraction element; and wherein (b) includes:

(b.1) receiving at least part of the non-planar engaging surface portion of the fraction element within the recess when the traction element is deflected toward the sole.

35. The method of claim 34, wherein the recess includes a geometry that at least partially corresponds with the geometry of the engaging surface portion of the traction element.

36. The method of claim 28, wherein the traction element includes a substantially planar engaging surface portion and the sole includes a recess aligned with the traction element; and wherein (b) includes:

(b.1) receiving at least part of the engaging surface portion of the traction element within the recess when the traction element is deflected toward the sole.

37. The method of claim 28, wherein the at least one traction element comprises a plurality of traction elements disposed along a perimeter of the hub, each traction element including a substantially smooth interior surface portion facing a center of the hub; and wherein (b) includes:

(b.1) in response to the forcing of the shoe against the turf surface, deflecting the traction elements toward the sole in a direction away from the hub center.

38. The method of claim 37, further comprising:

(d) contacting blades of grass disposed between traction elements with the smooth interior surface portions of the traction elements.

39. The method of claim 38, wherein the interior surface portion of each traction element is concave and the combined interior surface portions at least partially define a parabolic surface.

40. The method of claim 28, wherein the at least one cleat comprises a plurality of cleats secured at selected locations along the sole; and wherein (b) includes:

(b.1) in response to the forcing of the shoe against the turf surface, deflecting the traction elements toward the sole to engage and secure grass blades in the non-planar engaging surface areas disposed between the traction elements and the sole.

41. The method of claim 28, further comprising:

(d) crimping the grass blade within the engaging surface area when the traction element is deflected toward the sole.

42. The method of claim 28, wherein the shoe includes a connector disposed within a receptacle of the shoe, the cleat includes a connecting member disposed on a connecting surface of the hub that opposes the hub exposed surface, and the method further comprises:

(d) securing the cleat to the sole by engaging the connecting member of the cleat with the cleat connector.

43. A cleat securable to a sole of a shoe for providing traction for the shoe on a turf surface including blades of grass extending from the turf surface, the cleat comprising:

a hub with an exposed surface facing away from the shoe sole when the cleat is secured to the shoe and at least one resiliently flexible traction element extending away from the hub exposed surface and resiliently deflectable toward the shoe sole when the shoe is forced against the turf surface;

wherein the traction element includes a foot disposed at a distal end of the traction element, the foot including a substantially convex surface to engage the turf surface when the shoe is forced against the turf surface.

44. The cleat of claim 43, wherein the convex surface of the foot includes a suitable curvature to facilitate sliding of the foot along the turf surface when the shoe is forced against the turf surface and the traction element deflects toward the shoe sole.

45. The shoe of claim 13, wherein the non-planar engaging surface area is at least partially defined by a non-planar surface of the sole.

46. The method of claim 28, wherein the non-planar engaging surface area is at least partially defined by a non-planar surface of the sole.

47. A shoe for providing traction on a turf surface, the shoe comprising:

a sole; and at least one cleat secured to the sole, the cleat comprising a hub with an exposed surface facing away from the sole, a base surrounding the hub and disposed within a receptacle of the sole, and at least one resiliently flexible traction element extending from the hub in a direction away from the exposed surface of the hub;

wherein the traction element is resiliently deflectable toward the shoe sole and includes a first engaging surface portion that engages a second engaging surface portion disposed on the base surrounding the hub when the shoe is forced against the turf surface, and at least one of the first and second engaging surface portions is non-planar.

48. The shoe of claim 47, wherein the second engaging surface portion includes a recess to receive at least part of the first engaging surface portion.

49. The shoe of claim 47, wherein the second engaging surface portion includes a recess disposed on the shoe sole.

50. The shoe of claim 47, wherein the first engaging surface portion includes a linear intersection of two surfaces.

51. A shoe for providing traction on a turf surface, the shoe comprising:

a sole; and at least one cleat secured to the sole, the cleat comprising a hub with an exposed surface facing away from the sole and at least one resiliently flexible traction element extending from the hub in a direction away from the exposed surface of the hub;

wherein the traction element is resiliently deflectable toward the shoe sole and includes a first engaging portion that engages a second engaging portion disposed on at least one of the shoe sole and the cleat when the shoe is forced against the turf surface, and a linear intersection is defined by corresponding surfaces of the first and second engaging portions engaging with each other.

52. A shoe for providing traction on a turf surface, the shoe comprising:

a sole; and at least one cleat secured to the sole, the cleat comprising a hub with an exposed surface facing away from the sole and at least one resiliently flexible traction element extending from the hub in a direction away from the exposed surface of the hub;

wherein the traction element is resiliently deflectable toward the shoe sole and includes a first engaging portion that engages a second engaging portion disposed on at least one of the shoe sole and the cleat when the shoe is forced against the turf surface, and at least one of the first and second engaging portions includes a linear intersection of two surfaces.

53. A cleat securable to a sole of a shoe for providing traction for the shoe on a turf surface including blades of grass extending from the turf surface, the cleat comprising:

a hub with an exposed surface facing away from the shoe sole when the cleat is secured to the shoe and at least one resiliently flexible traction element extending from the hub in a direction away from the exposed surface of the hub; and a base surrounding the hub and including an exposed surface substantially flush with the shoe sole when the cleat is secured to the shoe, wherein the engaging surface area is disposed between an engaging surface portion of the traction element and an exposed surface portion of the base;

wherein the traction element is resiliently deflectable toward the shoe sole when the shoe is forced against the turf surface and is configured to engage and secure grass blades in a non-planar engaging surface area disposed between the traction element and the shoe when the traction element is deflected toward the shoe sole.

54. A shoe for providing traction on a turf surface including blades of grass extending from the turf surface, the shoe comprising:

a sole; and at least one cleat secured to the sole, the cleat comprising a hub with an exposed surface facing away from the sole, a base surrounding the hub and disposed within a receptacle of the sole such that an exposed surface of the base is substantially flush with the sole, and at least one resiliently flexible traction element extending from the hub in a direction away from the exposed surface of the hub;

wherein the traction element is resiliently deflectable toward the sole when the shoe is forced against the turf surface and is configured to engage and secure grass blades in a non-planar engaging surface area disposed between the traction element and the exposed surface of the base when the traction element is deflected toward the sole.

55. A shoe for providing traction on a turf surface including blades of grass extending from the turf surface, the shoe comprising:

a sole; and at least one cleat secured to the sole, the cleat comprising a hub with an exposed surface facing away from the sole and at least one resiliently flexible traction element extending from the hub in a direction away from the exposed surface of the hub;

wherein the traction element is resiliently deflectable toward the sole when the shoe is forced against the turf surface and is configured to engage and secure grass blades in a non-planar engaging surface area disposed between the traction element and the sole when the traction element is deflected toward the sole, the non-planar engaging surface area being defined by a non-planar engaging surface portion of the traction element that has a geometry selected from the group consisting of multifaceted surfaces, a curved surface, and combinations thereof; and wherein the sole includes at least one recess aligned to receive at least part of the non-planar engaging surface portion of the traction element when the traction element is deflected toward the sole.

56. A shoe for providing traction on a turf surface including blades of grass extending from the turf surface, the shoe comprising:

a sole; and at least one cleat secured to the sole, the cleat comprising a hub with an exposed surface facing away from the sole and at least one resiliently flexible traction element extending from the hub in a direction away from the exposed surface of the hub;

wherein the traction element is resiliently deflectable toward the sole when the shoe is forced against the turf surface and is configured to engage and secure grass blades in a non-planar engaging surface area disposed between the traction element and the sole when the traction element is deflected toward the sole; and wherein the traction element includes a substantially planar engaging surface portion and the sole includes a recess aligned with the traction element to receive at least part of the engaging surface portion when the traction element is deflected toward the sole.

57. A shoe for providing traction on a turf surface, the shoe comprising:

a sole; and at least one cleat secured to the sole, the cleat comprising a hub with an exposed surface facing away from the sole and at least one resiliently flexible traction element extending from the hub in a direction away from the exposed surface of the hub;

wherein the traction element is resiliently deflectable toward the shoe sole and includes a first engaging surface portion that engages a second engaging surface portion comprising a recess disposed on the shoe sole when the shoe is forced against the turf surface.

* * * * *